US007972124B2

(12) United States Patent
Hirata et al.

(10) Patent No.: US 7,972,124 B2
(45) Date of Patent: Jul. 5, 2011

(54) PIEZOELECTRIC MICRO-BLOWER

(75) Inventors: Atsuhiko Hirata, Yasu (JP); Gaku Kamitani, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/476,332

(22) Filed: Jun. 2, 2009

(65) Prior Publication Data

US 2009/0232684 A1 Sep. 17, 2009

Related U.S. Application Data

(63) Continuation of application No. PCT/JP2008/067236, filed on Sep. 25, 2008.

(30) Foreign Application Priority Data

Oct. 16, 2007 (JP) ..... 2007-268501

(51) Int. Cl.
*F04B 17/00* (2006.01)

(52) U.S. Cl. ..... 417/413.2

(58) Field of Classification Search ..... 417/413.1, 417/413.2, 410.2
See application file for complete search history.

(56) References Cited

U.S. PATENT DOCUMENTS

| | | | | |
|---|---|---|---|---|
| 4,512,716 | A * | 4/1985 | McHenry et al. | 415/205 |
| 7,550,034 | B2 * | 6/2009 | Van Rensburg et al. | 96/4 |
| 2005/0074662 | A1 | 4/2005 | Cho et al. | |
| 2006/0201327 | A1 | 9/2006 | Van Rensburg et al. | |

FOREIGN PATENT DOCUMENTS

| | | | |
|---|---|---|---|
| JP | 6-143571 | A | 5/1994 |
| JP | 2000-87862 | A | 3/2000 |
| JP | 2005-113918 | A | 4/2005 |
| JP | 2006-522896 | A | 10/2006 |
| WO | 2008/069266 | A1 | 6/2008 |

OTHER PUBLICATIONS

Official Communication issued in International Patent Application No. PCT/JP2008/067236, mailed on Oct. 21, 2008.

* cited by examiner

*Primary Examiner* — Devon C Kramer
*Assistant Examiner* — Bryan Lettman
(74) *Attorney, Agent, or Firm* — Keating & Bennett, LLP

(57) ABSTRACT

A blower body is provided with a first wall and a second wall, and openings are provided in the walls at positions facing the approximate center of a diaphragm. An inflow passage that allows the openings to communicate with the outside is arranged between the two walls. When the diaphragm is vibrated in response to a voltage applied to a piezoelectric element, the first wall vibrates near the opening and sucks in air from the inflow passage so that the air can be ejected from the opening. A plurality of branch passages which provide sound absorption are connected to an intermediate section of the inflow passage so as to prevent noise generated near the opening from leaking from an inlet.

6 Claims, 8 Drawing Sheets

MONITOR SAMPLE M

SAMPLE B

PIEZOELECTRIC MICRO-BLOWER

BACKGROUND OF THE INVENTION

1. Field of the Invention

The present invention relates to a piezoelectric micro-blower suitable for transporting a compressible fluid, such as air, for example.

2. Description of the Related Art

Piezoelectric micro-pumps are used as fuel transporting pumps for fuel cells or as coolant transporting pumps for small-sized electronic apparatuses, such as notebook computers. On the other hand, piezoelectric micro-blowers can be used as air blowers for CPUs in place of cooling fans or as air blowers for supplying oxygen necessary for generating fuel cells. Piezoelectric micro-pumps and piezoelectric micro-blowers both use a diaphragm that can be bent by applying a voltage to a piezoelectric element, and are both advantageous in that they have a simple structure and low profile as well as consuming low power.

Generally, when transporting a non-compressible fluid such as a liquid, check valves made of a soft material, such as rubber or resin, are provided at an inlet and an outlet, and the piezoelectric element is driven at a low frequency of about several tens of Hz. However, when using a micro-blower equipped with check valves to transport a compressible fluid such as air, the fluid can hardly be discharged since the amount of displacement of the piezoelectric element is extremely small. Although maximum displacement can be achieved by driving the piezoelectric element near the resonance frequency of the diaphragm (i.e., first-order resonance frequency or third-order resonance frequency), the check valves cannot be slave-driven since the resonance frequency is a high frequency on the order of kHz. Therefore, a piezoelectric micro-blower which does not include a check valve is preferable for transporting a compressible fluid.

Japanese Unexamined Patent Application Publication No. 2006-522896 discloses a gas-flow generator that includes an ultrasonic driver body having a piezoelectric disc attached to a stainless-steel disc, a first stainless-steel film body disposed on the stainless-steel disc, and a second stainless-steel film body attached substantially parallel to the ultrasonic driver body and separated from the ultrasonic driver body by a desired distance. The ultrasonic driver body can be bent by applying a voltage to the piezoelectric disc. The second stainless-steel film body is provided with a hole in the central section thereof.

Air is vibrated through the hole in the second stainless-steel film body. In the compression process, an inertial jet with high directivity is generated from this hole, whereas in the reverse process, an isotropic flow flowing into a hollow section is generated through this hole. Thus, an intensive jet stream is generated in a direction perpendicular to the surface of the film body. Since this gas-flow generator does not have a check valve, the ultrasonic driver body can be driven at a high frequency.

Furthermore, this gas-flow generator can be used together with a double-sided heat sink to dissipate heat from electrical components. Gas flowing along the surface of the second stainless-steel film body having the hole flows inside a passage along the top surface of the heat sink. The jet stream from the film body passes the heat sink by traveling through the center thereof. Subsequently, the jet stream flows through a passage on the bottom surface of the heat sink.

When transporting gas in the above-described manner, it is possible to generate a desired jet stream by driving the ultrasonic driver body near the resonance frequency thereof, but noise generated near an outlet or an inlet is significant. In general, the human ear can hear sound at a frequency of about several tens of Hz to about 20 kHz, but high-frequency sound in the range of about 7 kHz to about 10 kHz in particular is extremely disturbing to the human ear. Since a passage formed in a space between the second stainless-steel film body and the double-sided heat sink in the gas-flow generator disclosed in Japanese Unexamined Patent Application Publication No. 2006-522896 is merely a straight passage, noise (wind noise) generated near the hole undesirably leaks to the outside through the passage.

SUMMARY OF THE INVENTION

To overcome the problems described above, preferred embodiments of the present invention provide a piezoelectric micro-blower that produces a high flow rate of a compressible fluid without the use of a check valve and that minimizes leakage of noise to the outside.

A first preferred embodiment of the present invention provides a piezoelectric micro-blower including a blower body, a diaphragm whose outer periphery is fixed to the blower body and having a piezoelectric element, and a blower chamber provided between the blower body and the diaphragm. The diaphragm is bent by applying a voltage to the piezoelectric element so as to transport a compressible fluid. The piezoelectric micro-blower includes a first wall of the blower body, the first wall and the diaphragm defining the blower chamber therebetween, a first opening provided in a section of the first wall that faces a central portion of the diaphragm and enabling an inside and an outside of the blower chamber to be in communication with each other, a second wall provided opposite to the blower chamber with the first wall therebetween and separated from the first wall by a desired distance, a second opening provided in a section of the second wall that faces the first opening, an inflow passage provided between the first wall and the second wall and having an outer end in communication with the outside and an inner end connected to the first opening and the second opening, and a plurality of branch passages each having a closed end and being connected to an intermediate section of the inflow passage.

A second preferred embodiment of the present invention provides a piezoelectric micro-blower including a blower body, a diaphragm whose outer periphery is fixed to the blower body and having a piezoelectric element, and a blower chamber provided between the blower body and the diaphragm. The diaphragm is bent by applying a voltage to the piezoelectric element so as to transport a compressible fluid. The piezoelectric micro-blower includes a first wall of the blower body, the first wall and the diaphragm defining the blower chamber therebetween, a first opening provided in a section of the first wall that faces a central portion of the diaphragm and enabling an inside and an outside of the blower chamber to be in communication with each other, a second wall provided opposite the blower chamber with the first wall therebetween and separated from the first wall by a certain distance, a second opening provided in a section of the second wall that faces the first opening, an inflow passage provided between the first wall and the second wall and having an outer end in communication with the outside and an inner end connected to the first opening and the second opening, a third wall separated from the second wall by a desired distance, an outflow passage provided between the second wall and the third wall and having an outlet at one end that is in communication with the outside and another end connected to the second opening, and a plurality of branch passages each having a closed end and connected to an intermediate section of the outflow passage.

In the first preferred embodiment of the present invention, the distance between the diaphragm and the first opening is changed by bending the diaphragm. This change in the distance in the blower chamber between the diaphragm and the first opening causes a compressible fluid to flow at high speed through the first opening and the second opening. With this flow, the fluid from the inflow passage can be drawn into the first and second openings. Since a check valve is not provided in preferred embodiments of the present invention, the diaphragm can be bent and vibrated at a high frequency, and a subsequent flow can be generated in the first and second openings before the inertia of the fluid flowing through the inflow passage ends, whereby a flow directed towards the approximate center can be constantly created in the inflow passage. In other words, not only can the fluid from the inflow passage be drawn into the blower chamber through the first opening when the distance between the diaphragm and the first opening increases, but the fluid from the inflow passage can also be drawn into the second opening by the flow of fluid pushed outward from the blower chamber through the first opening and the second opening when the distance between the diaphragm and the first opening decreases. Since the fluid drawn in from the inflow passage and the fluid pushed out from the blower chamber merge before being discharged from the second opening, the flow rate of discharged fluid is greater than or equal to the displaceable volume of the pump chamber changed by the displacement of the diaphragm. In addition, since the first opening and the second opening face each other, the fluid pushed out from the first opening is ejected from the second opening without losing energy. Therefore, the flow rate can be effectively increased without causing the fluid flowing at high speed through the openings to flow backward into the inflow passage.

With the micro-blower having the above-described structure according to the related art, leakage of noise from the inflow passage may be a problem. In particular, when the diaphragm is driven near the resonance frequency thereof (i.e., first-order resonance frequency or third-order resonance frequency), aurally disturbing wind noise is generated over the range of about 2 kHz to about 10 kHz, for example. The reason for this is that, because the second opening defining a discharge port and the inflow passage communicate with each other, noise generated near the second opening may flow backward through the inflow passage so as to leak from an inlet.

In view of this, according to preferred embodiments of the present invention, the plurality of branch passages each having a closed end are provided at the intermediate section of the inflow passage. Thus, even when noise generated near the second opening flows backward through the inflow passage, the noise is attenuated by the sound absorbing effect of the branch passages, thereby significantly reducing leakage of the noise from the inlet. Although it is possible to reduce noise by configuring the inflow passage so as to have a maze-like structure to increase the length thereof, such a structure leads to an increase in the resistance of the passage and ultimately to a lower flow rate. In contrast, according to preferred embodiments of the present invention, noise can be reduced without having to increase the length of the inflow passage itself by simply connecting branch passages having a closed end thereto, thereby preventing a reduction in the flow rate.

In the second preferred embodiment of the present invention, branch passages arranged to absorb sound are provided at the outflow passage instead of the branch passages being provided at the inflow passage. The first preferred embodiment is effective when applied to a micro-blower that has an inlet that is exposed to the outside and in which wind noise in the inlet is preferably reduced. The second preferred embodiment is effective when applied to a micro-blower that has an outlet exposed to the outside and in which wind noise in the outlet is preferably reduced.

The diaphragm included in various preferred embodiments of the present invention may have any type of structure, such as a unimorph structure in which a piezoelectric element that is expandable and contractible in the planar direction is bonded to one side of a vibrating plate made of a resin plate or a metal plate, a bimorph structure in which piezoelectric elements that are expandable and contractible in opposite directions are bonded to both sides of a vibrating plate, or a structure in which a bendable bimorph piezoelectric element is bonded to one side of a vibrating plate. The diaphragm may be of any type as long as it can be bent and vibrated in the thickness direction thereof in response to an alternating voltage (i.e., sine-wave voltage or rectangular-wave voltage) applied to the piezoelectric element.

The inflow passage may preferably include a plurality of passages having a curved or bent shape and extending radially from an approximate center thereof that is connected to the first opening and the second opening. Curving the inflow passage improves the sound attenuating effect, as compared to a linear passage. By providing a plurality of inflow passages, the resistance against the fluid can be further reduced.

The branch passages may preferably be configured to have a substantially circular-arc shape that is concentric with the first opening and the second opening. Although the branch passages may have any suitable shape, configuring them to have a substantially concentric circular-arc shape prevents the blower body from having a large size regardless of an increase in the number of branch passages, thereby enabling a small-sized micro-blower. In particular, the branch passages may be arranged in engagement with each other to define a comb-shaped pattern so as to achieve a micro-blower that is even smaller in size and has greater sound absorbing properties. The width and the length of each branch passage may be freely set depending on the frequency of sound to be attenuated.

According to the first preferred embodiment of the present invention, the first opening is provided in the first wall of the blower body so as to face the central portion of the diaphragm, the second opening is provided at a position facing the first opening in the second wall separated from the first wall by a desired distance, and the inflow passage is provided between the first wall and the second wall. Consequently, by utilizing the flow of fluid flowing at high speed through the first and second openings, the fluid from the inflow passage can be sucked into the openings not only when the distance between the diaphragm and the first opening increases but also when the distance decreases. Therefore, the flow rate of discharged fluid can be greater than or equal to the volume of the pump chamber changed by the displacement of the diaphragm. Furthermore, the plurality of branch passages, each having a closed end, are connected to the intermediate section of the inflow passage. Thus, even when noise generated near the second opening flows backward into the inflow passage, the noise is attenuated by the sound absorbing effect of the branch passages, thereby minimizing leakage of the noise from the inlet.

According to the second preferred embodiment of the present invention, the sound-absorbing branch passages are provided at the outflow passage between the second wall and the third wall, thereby effectively reducing leakage of noise from the outlet.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the drawings.

First Preferred Embodiment

Figure 1:
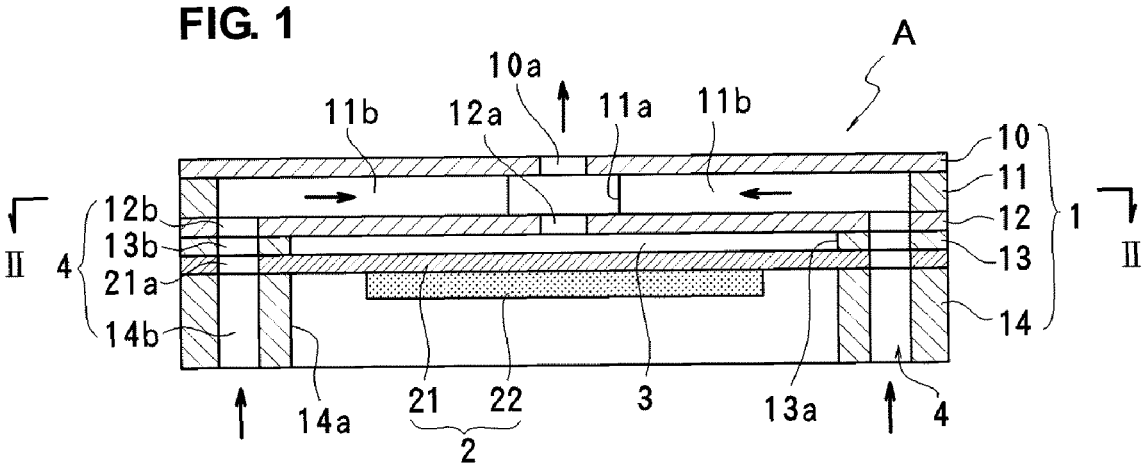
FIG. 1 is a cross-sectional view of a piezoelectric micro-blower according to a first preferred embodiment of the present invention.
Figure 2:
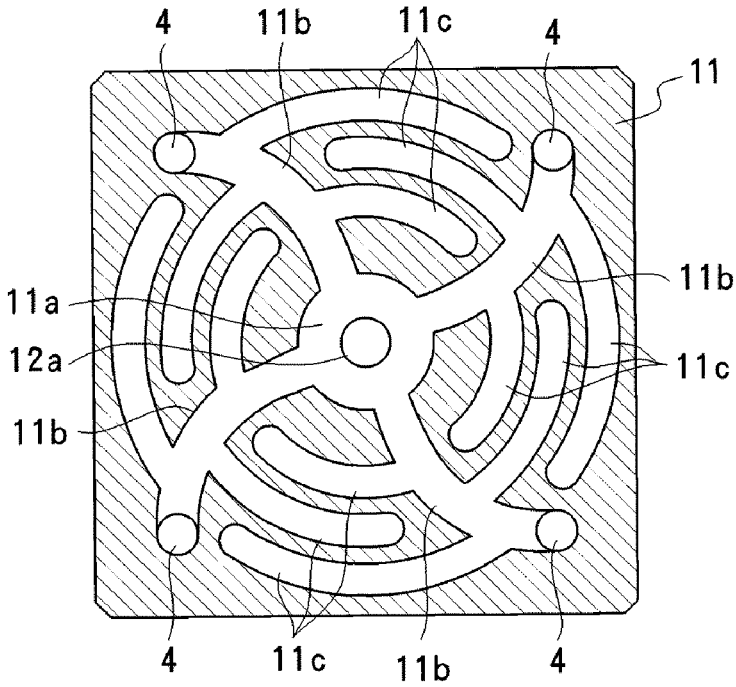
FIG. 2 is a cross-sectional view taken along line II-II in FIG. 1.
Figure 3:
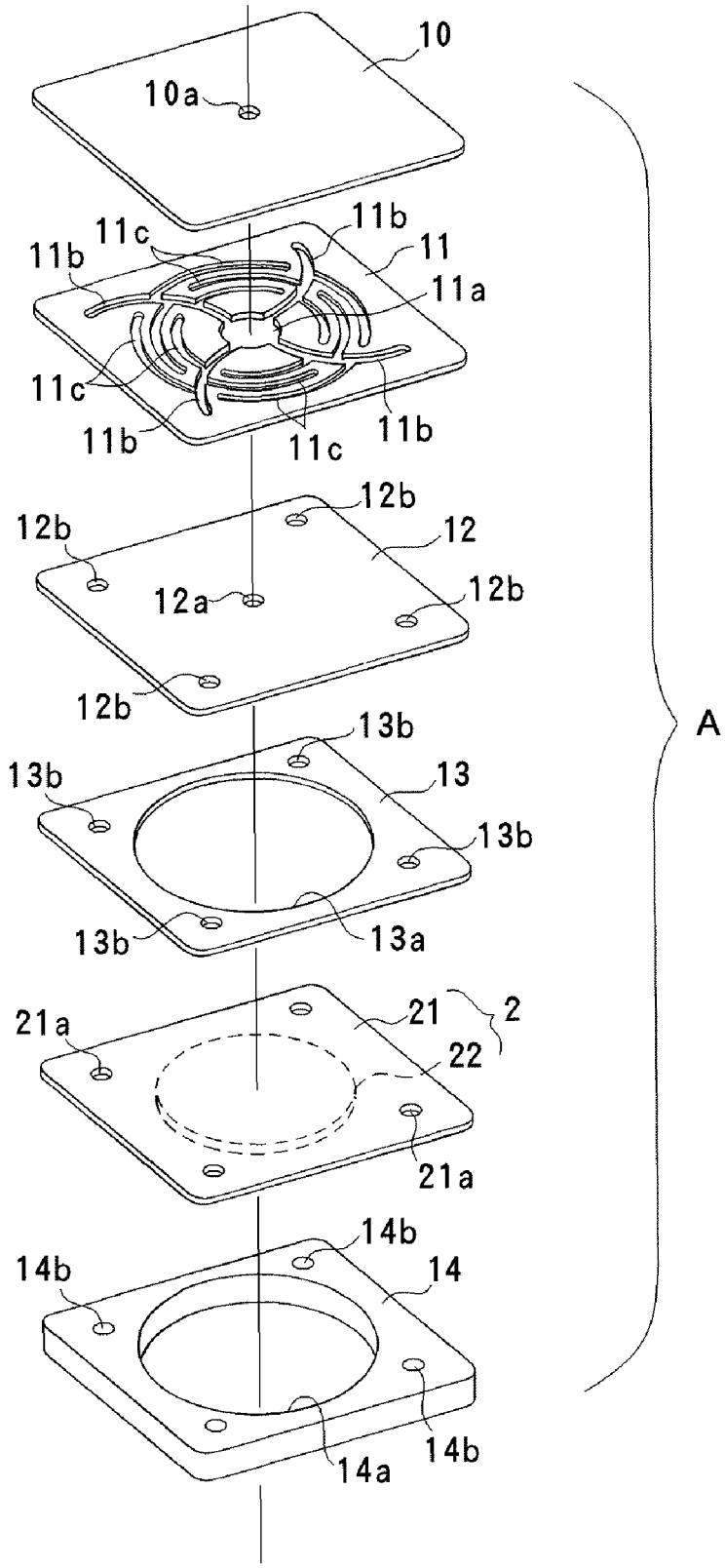
FIG. 3 is an exploded perspective view of the piezoelectric micro-blower shown in FIG. 1.

FIGS. 1 to 3 illustrate a piezoelectric micro-blower according to a first preferred embodiment of the present invention. A piezoelectric micro-blower A according to the present preferred embodiment is an example used as an air cooling blower for an electronic apparatus and is substantially defined by a blower body 1 and a diaphragm 2 whose outer periphery is fixed to the blower body 1.

The blower body 1 includes a top plate (second wall) 10, a passage-forming plate 11, a separator (first wall) 12, a blower-frame body 13, and a bottom plate 14 that are stacked in that order from the top down. The diaphragm 2 is fixed between the blower-frame body 13 and the bottom plate 14 with an adhesive, for example. The components 10 to 14 excluding the diaphragm 2 are preferably made of a rigid flat-plate material, such as a metal plate or a hard resin plate, for example.

The top plate 10 is preferably made of a substantially flat rectangular plate and includes a discharge port (second opening) 10*a* that extends through the approximate center from the top side to the bottom side thereof.

The passage-forming plate 11 is also preferably a substantially flat plate having the same or substantially the same outer shape as the top plate 10. The approximate center of the passage-forming plate 11 is provided with a center hole 11*a* with a diameter greater than that of the discharge port 10*a*. Arc-shaped inflow passages 11*b* extend radially from the center hole 11*a* toward the four corners. Moreover, each of the inflow passages 11*b* is connected to a plurality of branch passages 11*c* each having a closed end. In this preferred embodiment, four inflow passages 11*b* are preferably provided, for example, and each inflow passage 11*b* includes three branch passages 11*c* extending therefrom in a substantially circular-arc shape that is concentric with the center hole 11*a*. The branch passages 11*c* extending toward each other from two neighboring inflow passages 11*b* are alternately arranged in engagement with each other in the radial direction.

The separator 12 preferably is also a substantially flat plate having the same or substantially the same outer shape as the top plate 10 and includes a through-hole 12*a* (first opening) provided in the approximate center thereof at a position facing the discharge port 10*a* and having substantially the same diameter as the discharge port 10*a*. The four corner regions are provided with inflow holes 12*b* at positions corresponding to the terminals of the inflow passages 11*b*. By adhering the top plate 10, the passage-forming plate 11, and the separator 12 together, the discharge port 10*a*, the center hole 11*a*, and the through-hole 12*a* are aligned on the same or substantially the same axis so as to correspond to the approximate center of the diaphragm 2 to be described later.

The blower-frame body 13 is also a substantially flat plate having the same or substantially the same outer shape as the top plate 10 and has a large-diameter hollow section 13*a* provided in the approximate center thereof. The four corner regions are provided with inflow holes 13*b* at positions corresponding to the inflow holes 12*b*. By adhering the separator 12 and the diaphragm 2 together with the blower-frame body 13 interposed therebetween, a blower chamber 3 is defined by the hollow section 13*a* of the blower-frame body 13.

The bottom plate 14 is also a substantially flat plate having the same outer shape as the top plate 10 and includes a hollow section 14*a* provided in the approximate center thereof and having substantially the same shape as the blower chamber 3. The bottom plate 14 is thicker than the sum of the thickness of a piezoelectric element 22 and a displaceable amount of a metal plate 21 and prevents the piezoelectric element 22 from coming into contact with a board even if the micro-blower A is to be mounted on a board. The hollow section 14*a* surrounds the periphery of the piezoelectric element 22 of the diaphragm 2 to be described later. The four corner regions of the bottom plate 14 have inflow holes 14*b* provided at positions corresponding to the inflow holes 12*b* and 13*b*.

The diaphragm 2 has a structure in which the piezoelectric element 22 having a substantially circular shape is bonded to a central section of the bottom surface of the metal plate 21. The piezoelectric element 22 is a substantially circular disc with a diameter less than that of the hollow section 13*a* in the aforementioned blower-frame body 13. In this preferred embodiment, a single plate of a piezoelectric ceramic material having electrodes on the top and bottom sides thereof is preferably used as the piezoelectric element 22 and is bonded to the bottom side of the metal plate 21 (i.e., the side opposite the blower chamber 3) so as to define a unimorph diaphragm. By applying an alternating voltage (i.e., sine wave or rectangular wave) to the piezoelectric element 22, the piezoelectric element 22 expands and contracts in the planar direction, causing the entire diaphragm 2 to bend in the thickness direction thereof. When an alternating voltage that causes the diaphragm 2 to bend in the first-order resonance mode or the third-order resonance mode is applied to the piezoelectric element 22, the displacement of the diaphragm 2 can be significantly increased as compared to when applying a voltage with a frequency other than the above-described frequency to the piezoelectric element 22, whereby the flow rate can be greatly increased.

The four corner regions of the metal plate 21 are provided with inflow holes 21*a* at positions corresponding to the inflow holes 12*b*, 13*b*, and 14*b*. The inflow holes 12*b*, 13*b*, 14*b*, and 21*a* define inlets 4 each having one end facing downward and another end communicating with the corresponding inflow passage 11*b*.

As shown in FIG. 1, the inlets 4 of the piezoelectric micro-blower A are exposed at the bottom of the blower body 1, whereas the discharge port 10*a* is exposed at the top surface thereof. Since a compressible fluid can be sucked in from the inlets 4 at the bottom side of the piezoelectric micro-blower A and then ejected from the discharge port 10*a* at the top side, this structure is suitable for a pneumatic blower for a fuel cell or an air cooling blower for a CPU. The inlets 4 do not necessarily need to be exposed at the bottom and may alternatively be exposed at the outer periphery.

Figure 4A:
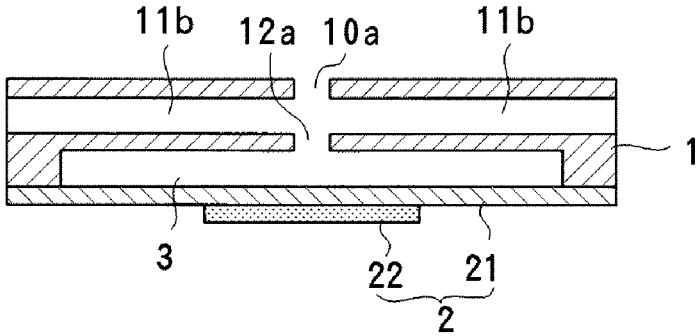
FIGS. 4A to 4E include principle diagrams showing an operation of the piezoelectric micro-blower shown in FIG. 1.
Figure 4B:
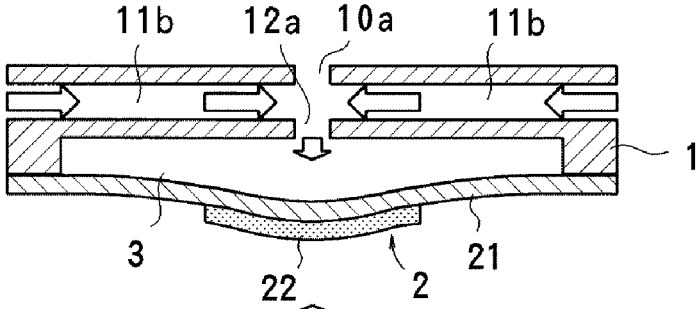
Figure 4C:
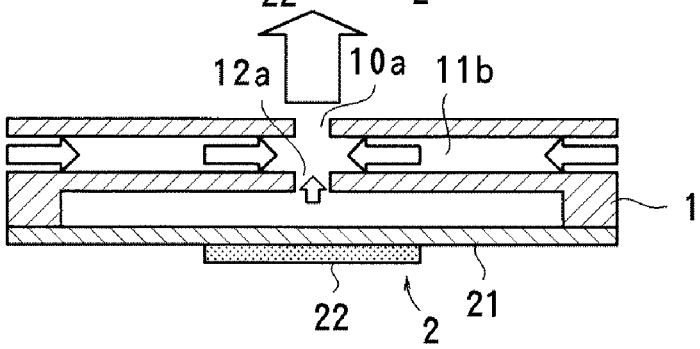
Figure 4D:
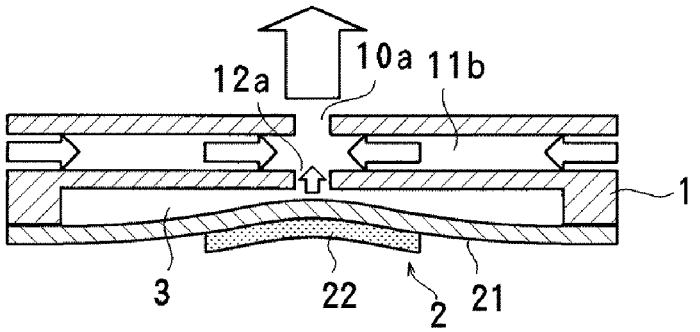
Figure 4E:
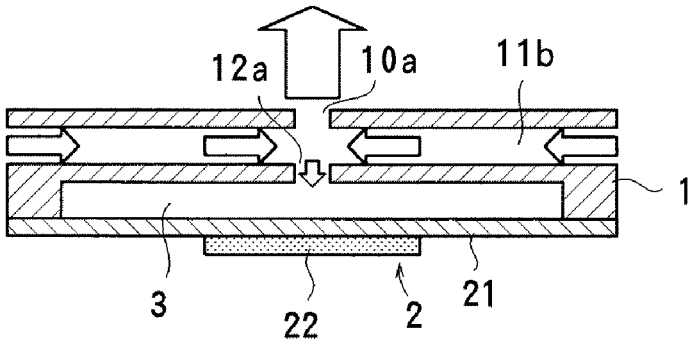

The operation of the piezoelectric micro-blower A having the above-described configuration will now be described with reference to FIGS. 4A to 4E. FIG. 4A shows an initial state (when voltage is not applied) in which the diaphragm 2 is flat. FIG. 4B shows a first quarter period when a voltage is applied to the piezoelectric element 22. In this state, because the diaphragm 2 bends into a downward convex shape, the distance between the diaphragm 2 and the first opening 12*a* increases, thereby causing fluid to be sucked into the blower chamber 3 from the inflow passages 11*b* through the first opening 12*a*. The arrows indicate the flow of fluid. As the diaphragm 2 recovers into its flat shape in the subsequent quarter period as shown in FIG. 4C, the distance between the diaphragm 2 and the first opening 12*a* decreases, thereby causing the fluid to be pushed outward in the upper direction through the openings 12*a* and 10*a*. At the same time, the fluid flowing upward carries the fluid from the inflow passages 11*b* along with it, whereby a high flow rate is obtained at the exit side of the second opening 10*a*. In the next quarter period, the diaphragm 2 bends into an upward convex shape as shown in FIG. 4D. Thus, the distance between the diaphragm 2 and the first opening 12*a* further decreases, thereby causing the fluid in the blower chamber 3 to be pushed outward in the upper direction at high speed through the openings 12*a* and 10*a*. Since this fluid flowing at high speed flows upward while carrying more of the fluid from the inflow passages 11*b* along with it, a high flow rate is obtained at the exit side of the second opening 10*a*. As the diaphragm 2 recovers into its flat shape in the subsequent quarter period as shown in FIG. 4E, the distance between the diaphragm 2 and the first opening 12*a* increases. Although this causes a fluid to be slightly sucked into the blower chamber 3 through the first opening 12*a*, the fluid in the inflow passages 11*b* continues to flow towards the approximate center and be pushed out to the outside of the blower chamber due to inertia. Subsequently, the operation of the diaphragm 2 returns to the state shown in FIG. 4B, and then repeats the cycle of processes shown in FIGS. 4B to 4E. By bending and vibrating the diaphragm 2 at a high frequency, a subsequent flow can be generated in the openings 12*a* and 10*a* before the inertia of the fluid flowing through the inflow passages 11*b* ends, whereby a flow directed towards the approximate center can be continuously created in the inflow passages 11*b*.

With the piezoelectric micro-blower A according to this preferred embodiment, since the inflow passages 11*b* communicate with the center openings 12*a* and 10*a* from four directions, the fluid can be drawn in towards the openings 12*a* and 10*a* without resistance as the diaphragm 2 undergoes a pumping process. This further increases the flow rate. Although this micro-blower A is advantageous in having the ability to obtain a high flow rate, because the discharge port 10*a* is in communication with the inflow passages 11*b*, wind noise generated at the discharge port 10*a* may undesirably flow backward through the inflow passages 11*b* so as to leak outward from the inlets 4. As a countermeasure against such noise, in preferred embodiments of the present invention, the inflow passages 11*b* are connected to the plurality of branch passages 11*c* each having a closed end.

To confirm the noise reducing effect of the micro-blower A according to preferred embodiments of the present invention, a noise test is performed under the following conditions using a monitor sample M and a sample B as comparative examples. A configuration of the micro-blower A is as follows. First, a diaphragm is prepared by bonding a piezoelectric element made of a PZT single plate having a thickness of about 0.15 mm and a diameter of about 11 mm onto a 42-Ni plate having a thickness of about 0.08 mm, for example. Then, a separator made of a brass plate, and a top plate, a passage-forming plate, a blower-frame body, and a bottom plate made of SUS plates are prepared. The approximately center of the top plate is provided with a second opening having a diameter of about 0.8 mm, and the approximate center of the separator is provided with a first opening having a diameter of about 0.6 mm, for example. The blower-frame body is the same or substantially the same as that shown in FIG. 2 and is provided with arc-shaped inflow passages 11*b* extending radially from a center hole 11*a* having a diameter of about 6 mm, for example. Each inflow passage 11*b* has a width of about 1.6 mm, a length of about 10 mm, and a height of about 0.4 mm, for example. Moreover, a plurality of arc-shaped branch passages 11*c* are arranged to branch off from each of the inflow passages 11*b*. Each branch passage 11*c* has a width of about 1.6 mm and a length of about 5 mm to about 10 mm, for example. Subsequently, the above-described components are stacked and adhered to each other in the following order: the bottom plate, the diaphragm, the blower-frame body, the separator, the passage-forming plate, and the top plate, thereby forming a blower body that is about 20 mm in the longitudinal direction, about 20 mm in the lateral direction, and about 2.4 mm in the height direction, for example. A blower chamber in the blower body has a height of about 0.15 mm and a diameter of about 16 mm, for example.

When the micro-blower A having the above-described configuration is driven by applying a sine-wave voltage of about ±20 Vp-p at a frequency of about 24 kHz thereto, a flow rate of about 800 ml/min is obtained at about 100 Pa, for example. Although this is an example in which the micro-blower A is driven in the third-order mode, the micro-blower A can also be driven in the first-order mode. Accordingly, a micro-blower with a high flow rate can be obtained.

Figure 5:
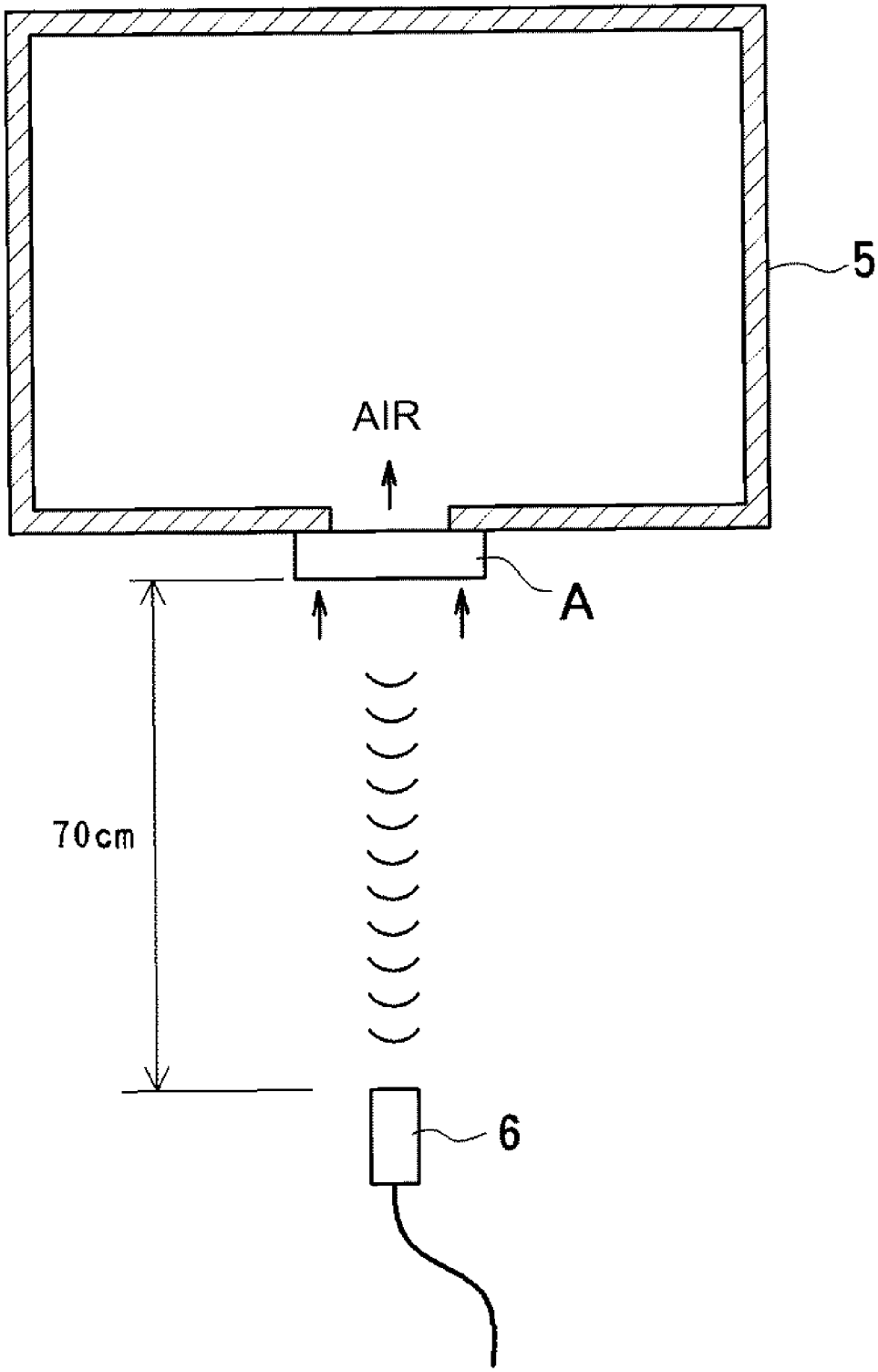
FIG. 5 illustrates a method for measuring sound generated from the piezoelectric micro-blower.

FIG. 5 illustrates a state in which noise is being measured. The micro-blower A is attached to a housing 5 such that the discharge port 10*a* faces the interior of the housing 5. A microphone 6 is disposed a distance away from the micro-blower A by about 70 cm so as to measure the level of noise leaking from the inlets 4 when the micro-blower A is driven.

Figure 6A:
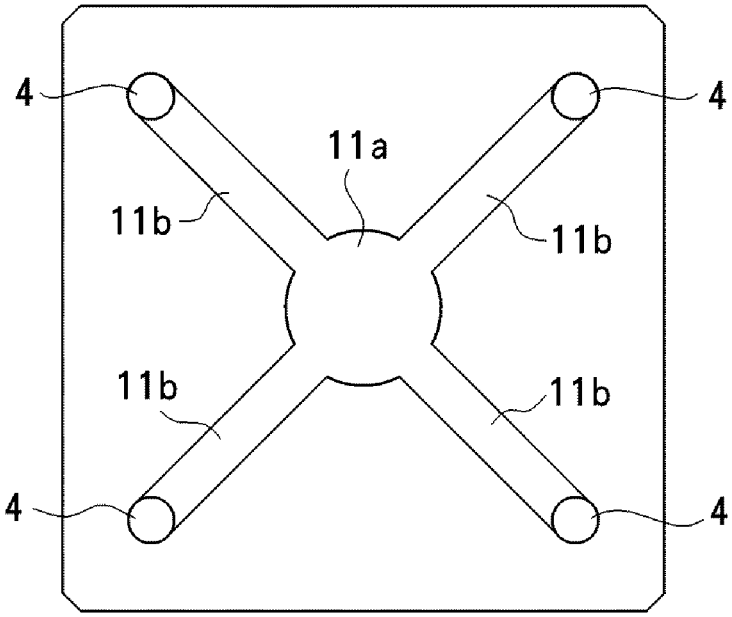
FIGS. 6A and 6B include diagrams showing the shapes of inflow passages in comparative samples.
Figure 6B:
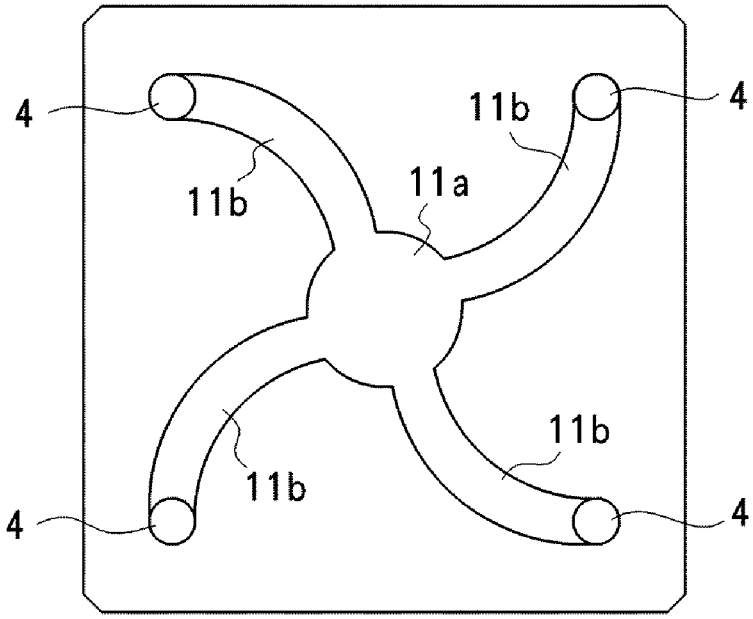

The monitor sample M has linear inflow passages 11*b* extending radially from the center hole 11*a*, as shown in FIG. 6A, whereas the sample B has arc-shaped inflow passages 11*b* extending radially from the center hole 11*a*, as shown in FIG. 6B. Neither of the samples includes branch passages.

Figure 7:
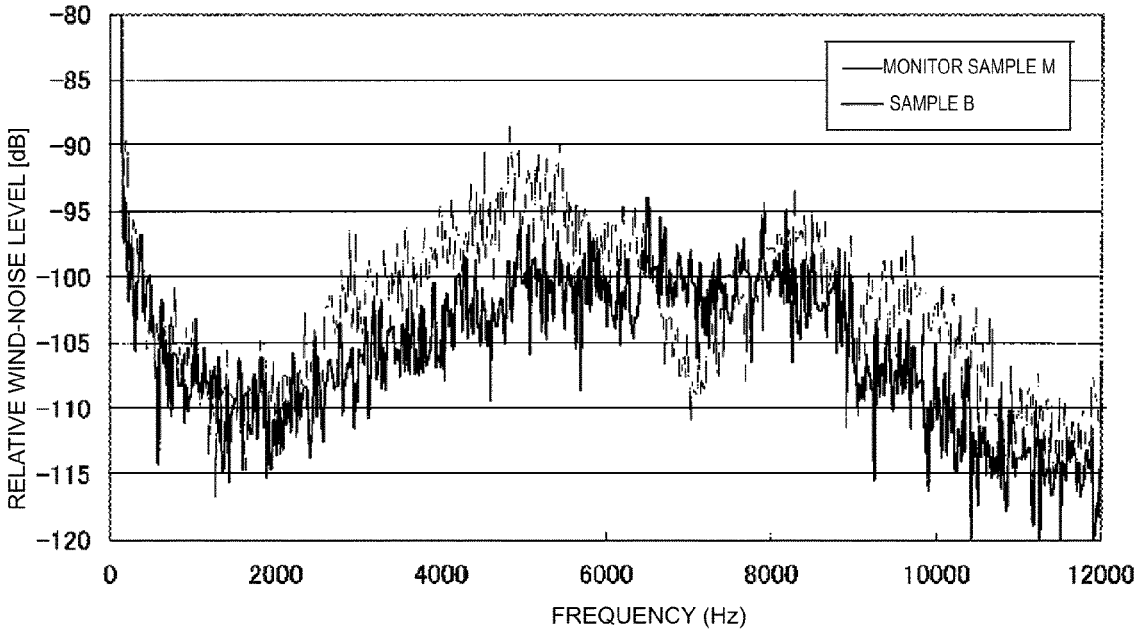
FIG. 7 illustrates frequency characteristics of sound pressure levels of a monitor sample and a sample B.
Figure 8:
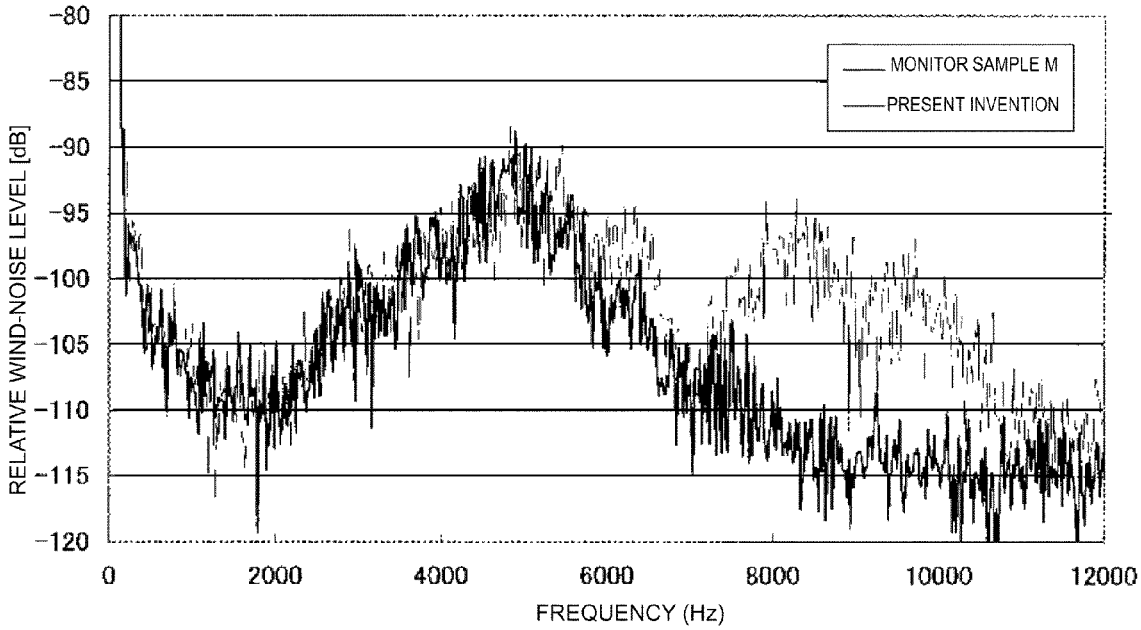
FIG. 8 illustrates frequency characteristics of sound pressure levels of the monitor sample and the micro-blower according to a preferred embodiment of the present invention.

FIG. 7 illustrates frequency characteristics of relative sound pressure levels of the monitor sample M and the sample B. FIG. 8 illustrates frequency characteristics of relative sound pressure levels of the monitor sample M and the micro-blower A according to a preferred embodiment of the present invention. Regarding the monitor sample M, large wind noise is generated over a wide frequency range of about 2 kHz to about 10 kHz, and the sound pressure in the high range of about 7 kHz to about 10 kHz, which includes particularly disturbing high-frequency sound, is large. In the case of the sample B, the sound pressure in the low range of about 2 kHz to about 6 kHz is lower as compared to the monitor sample M, but the sound pressure in the high range is not significantly reduced. On the other hand, in the case of the preferred embodiment of the present invention, the sound pressure in the high range of about 7 kHz to about 10 kHz is significantly reduced, as shown in FIG. 8. Since the sample B and the micro-blower A of the present preferred embodiment of the present invention only differ from each other in the presence and absence of the branch passages 11*c*, it is proven that the noise in the high range is effectively reduced by the branch passages 11*c*.

Second Preferred Embodiment

Figure 9:
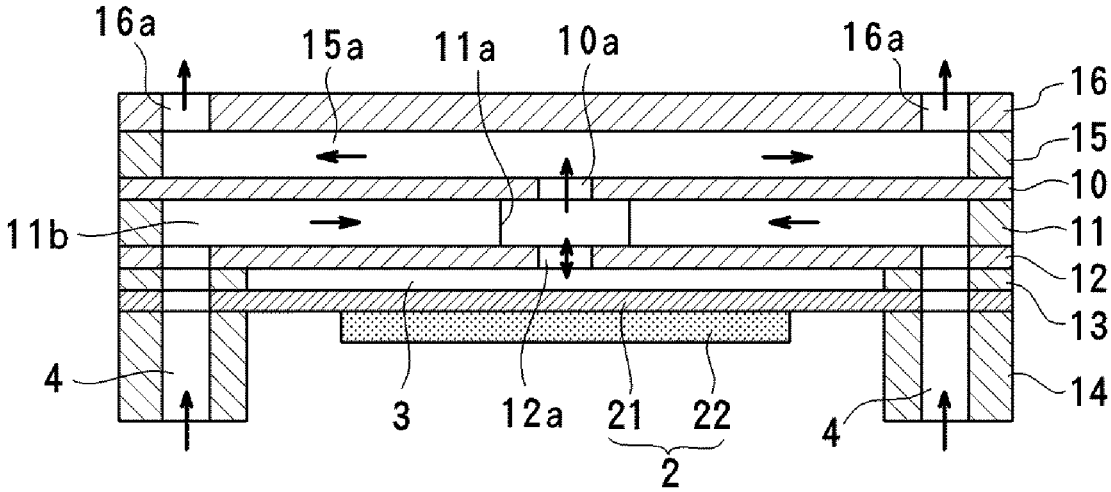
FIG. 9 is a cross-sectional view of a piezoelectric micro-blower according to a second preferred embodiment of the present invention.

FIG. 9 illustrates a second preferred embodiment of the present invention. Components that are the same as those in the first preferred embodiment are given the same reference numerals, and descriptions thereof will be omitted. In the second preferred embodiment, a second top plate 16 is fixed to the top surface of the top plate 10 with a second passage-forming plate 15 interposed therebetween. The second passage-forming plate 15 is provided with outflow passages 15*a* and branch passages (not shown) that have the same or substantially the same shapes as those in the passage-forming plate 11 shown in FIG. 2. An outer peripheral end of each outflow passage 15*a* is in communication with a corresponding outlet (outflow port) 16*a* provided in an outer peripheral section of the second top plate 16. Therefore, a fluid discharged from the discharge port 10*a* passes through the outflow passages 15*a* so as to be ejected from the outflow portions 16*a*. Although high-frequency noise is also generated from the discharge port 10*a* in this preferred embodiment, the sound absorbing effect of the branch passages provided at the outflow passages 15*a* minimizes the sound leakage from the outlets 16*a*. The inflow passages 11*b* and the branch passages 11*c* in the passage-forming plate 11 do not necessarily need to have the same or substantially the same shapes as those shown in FIG. 2, and the branch passages 11*c* may alternatively be omitted.

Although providing the branch passages at the outflow passages 15*a* as described above may cause the flow rate to be somewhat lower as compared to the first preferred embodiment, the noise released from the outlets 16*a* of the second top plate 16 can be reduced relative to the noise generated near the discharge port 10*a*.

The first preferred embodiment provides a structure that is effective for a micro-blower of an exposed-inlet type which is used in a state in which the inlets 4 are exposed to the outside, as shown in FIG. 5. With this structure, leakage of noise from the inlets 4 can be reduced. On the other hand, the second preferred embodiment provides a structure that is effective for a micro-blower of an exposed-outlet type which is used in a state in which the outlets 16*a* are exposed to the outside. With this structure, leakage of noise from the outflow ports 16*a* can be reduced.

Although there are preferably four arc-shaped inflow passages extending radially from the center hole in the above-described preferred embodiments, the number and the shape of inflow passages are appropriately selectable depending on the conditions, such as the flow rate. Furthermore, although the branch passages extend in a substantially circular-arc shape concentric with the center hole, the present invention is not limited to this, and the number of branch passages is not limited to that described in the preferred embodiments. The blower body according to the present invention is not limited to a multilayer structure formed by stacking a plurality of plate members as in the preferred embodiments, and is modifiable in a freely chosen manner.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A piezoelectric micro-blower comprising:

a blower body;

a diaphragm having an outer periphery fixed to the blower body and including a piezoelectric element; and a blower chamber provided between the blower body and the diaphragm; wherein the diaphragm is arranged to be bent in response to application of a voltage to the piezoelectric element so as to transport a compressible fluid;

the piezoelectric micro-blower further comprises:

a first wall of the blower body, the first wall and the diaphragm defining the blower chamber therebetween;

a first opening provided in a section of the first wall that faces an approximate center of the diaphragm, the first opening being arranged to provide communication between an inside and an outside of the blower chamber;

a second wall of the blower body provided opposite the blower chamber with the first wall therebetween and separated from the first wall by a distance;

a second opening provided in a section of the second wall that faces the first opening;

at least one passage-forming member disposed between the first wall and the second wall of the blower body and including a central opening disposed between and facing the first opening and the second opening;

at least one inflow passage provided in the at least one passage-forming member, extending outwardly from the central opening and including an outer end in fluid communication with an outside of the blower body and an inner end in fluid communication with and connected to the central opening; and a plurality of branch passages provided in the at least one passage-forming member, each of the plurality of branch passages including an open end in fluid communication with and connected to an intermediate section of the at least one inflow passage disposed between the inner end and the outer end of the at least one inflow passage, and a closed end opposite to the open end and spaced away from the at least one inflow passage.

2. The piezoelectric micro-blower according to claim 1, wherein the at least one inflow passage includes a plurality of passages having a curved or bent shape and extending radially outward from the central opening.

3. The piezoelectric micro-blower according to claim 1, wherein the plurality of branch passages have a substantially circular-arc shape concentric with the first opening and the second opening.

4. A piezoelectric micro-blower comprising:

a blower body;

a diaphragm having an outer periphery fixed to the blower body and including a piezoelectric element; and a blower chamber provided between the blower body and the diaphragm; wherein the diaphragm is arranged to be bent in response to application of a voltage to the piezoelectric element so as to transport a compressible fluid; and the piezoelectric micro-blower further comprises:

a first wall of the blower body, the first wall and the diaphragm defining the blower chamber therebetween;

a first opening provided in a section of the first wall that faces an approximate center of the diaphragm, the first opening being arranged to provide communication between an inside and an outside of the blower chamber;

a second wall provided opposite the blower chamber with the first wall therebetween and separated from the first wall;

a second opening provided in a section of the second wall that faces the first opening;

at least one first passage-forming member disposed between the first wall and the second wall of the blower body and including a central opening disposed between and facing the first opening and the second opening;

at least one inflow passage provided in the at least one first passage-forming member, extending outwardly from the central opening and including an outer end in fluid communication with an outside of the blower body and an inner end in fluid communication with and connected to the central opening;

a third wall separated from the second wall;

at least one second passage-forming member disposed between the second wall and the third wall of the blower body;

at least one outflow passage provided in the at least one second passage-forming member, extending outwardly from the second opening and including an outlet at an outer end that is in communication with the outside of the blower body and an inner end in fluid communication with and connected to the second opening; and a plurality of branch passages provided in the at least one second passage-forming member, each of the plurality of branch passages including an open end in fluid communication with and connected to an intermediate section of the at least one second inflow passage disposed between the inner end and the outer end of the at least one second inflow passage, and a closed end opposite to the open end and spaced away from the at least one second inflow passage.

5. The piezoelectric micro-blower according to claim 4, wherein the at least one inflow passage includes a plurality of inflow passages having a curved or bent shape and extending radially outward from the central opening.

6. The piezoelectric micro-blower according to claim 4, wherein the plurality of branch passages have a substantially circular-arc shape concentric with the first opening and the second opening.

* * * * *